United States Patent [19]

Schmidt et al.

[11] Patent Number: 4,829,746

[45] Date of Patent: May 16, 1989

[54] APPARATUS FOR PLACING A WEB OF FILM UNDER TENSION

[75] Inventors: Josef Schmidt, Libertyville, Ill.; Dallas L. Woods, Marion, N.C.

[73] Assignee: Baxter Travenol Laboratories, Inc., Deerfield, Ill.

[21] Appl. No.: 77,707

[22] Filed: Jul. 24, 1987

[51] Int. Cl.[4] ..... B65B 9/20

[52] U.S. Cl. ..... 53/451; 53/551; 53/373; 26/83; 226/17; 226/187

[58] Field of Search ..... 53/451, 551, 552, 554, 53/373; 493/302; 26/83, 84; 226/17, 187

[56] References Cited

U.S. PATENT DOCUMENTS

| | | | |
|---|---|---|---|
| 3,149,447 | 9/1964 | Dorr | 53/551 |
| 3,335,540 | 8/1967 | Reil . | |
| 3,470,672 | 10/1969 | Tuma . | |
| 3,613,524 | 10/1971 | Behr | 493/302 |
| 3,681,892 | 8/1972 | Safranski | 53/551 |
| 3,752,377 | 8/1973 | Knapp | 226/17 X |
| 3,886,714 | 6/1975 | de la Poype . | |
| 3,975,888 | 8/1976 | Jones . | |
| 4,004,399 | 1/1977 | Borrello | 53/554 |
| 4,043,098 | 8/1977 | Putnam, Jr. . | |
| 4,103,473 | 8/1978 | Bast . | |
| 4,235,362 | 11/1980 | Hubenko | 226/187 X |
| 4,534,159 | 8/1935 | Kelly | 53/373 X |
| 4,589,247 | 5/1986 | Tsuruta | 53/551 X |

FOREIGN PATENT DOCUMENTS

| | | | |
|---|---|---|---|
| 1186392 | 1/1965 | Fed. Rep. of Germany | 53/552 |

*Primary Examiner*—John Sipos

*Attorney, Agent, or Firm*—Paul C. Flattery; Robert M. Barrett; John P. Kirby, Jr.

[57] ABSTRACT

An apparatus for placing a folded web of film under tension comprising at least one pair of rollers, a first side of the folded web of film being fed between the pair of rollers, the pair of rollers being mounted out of parallel to the first side of the folded web of film and pulling the first side of the folded web of film in a first direction, and a member for preventing a second side of the folded web of film from moving in the first direction. Preferably, the member biases the second side of the folded web of film in a second direction opposite the first direction. A method for placing a folded web of film under tension is also provided.

25 Claims, 3 Drawing Sheets

APPARATUS FOR PLACING A WEB OF FILM UNDER TENSION

DESCRIPTION

The present invention relates in general to apparatus for placing a web of film under tension. More specifically, the present invention relates to an apparatus for placing a web of film under tension in a packaging machine.

An example of a packaging machine is a form, fill, seal packaging machine. Typically, form, fill, seal packaging machines are utilized to package a product in a flexible container. To this end, form, fill, seal packaging machines are used to seal pharmaceuticals, dairy products, wine, food stuffs, cosmetics, and other products in flexible containers. The form, fill, seal packaging machine provides an apparatus for packaging these products in an expedient manner.

In one type of form, fill, seal packaging machine, a web of heat sealable film is passed over a former or mandrel that forms the film into a tubular shape. To effect the tubular shape, the film is folded longitudinally and heat sealed along abutting longitudinal edges (to create the fin seal). The tubular-shaped film is then passed around a tubular fill system that deposits the product to be packaged into the tubular-shaped film. To create individual packages (hereinafter "bags"), the web of film must be sealed along its width by side seals. The side seals are typically created by a sealer that creates the second side seal of one bag while making the first side seal for the next bag. After the side seals are created, the web of film can then be severed between the side seals to create individual bags.

It may also be desirable, in some arts, to attach fitments to the web of film during the form, fill, seal process to create bags having fitments thereon. The fitments provide a means for accessing the contents of the container. An example of such a flexible bag is the VIAFLEX® container produced by Travenol Laboratories of Deerfield, Ill.

As stated above, in order to create individual flexible bags in a form, fill, seal packaging machine, it is necessary to create side seals in the web of film, with the web of film being severed between these side seals. The side seals are created by causing the folded web of film to be melted to itself. To this end, for example, it is known to use a hot bar or impulse system to heat the web of film to a sufficient temperature where it melts to itself. In order to create a sufficiently strong side seal, it is desirable that the area in which the side seals are created does not contain wrinkles or creases. If the web of film is sealed to itself at a wrinkle or crease, a complete or strong seal may not be created.

Therefore, it is desirable to stretch or to put under tension the web of film at the side seal station. As stated above, side seals are typically created after the filling station in the form, fill, seal packaging machine. It is known to put a web of film under tension utilizing a continuous chain operated device that has attached gripper pins. The gripper pins perforate the web of film at the fin seal to stretch and put the film under tension. However, in order to function, the gripper pins must perforate the film thereby perforating the fin seal area creating an aesthetically unpleasing container and possibly damaging the film. Moreover, these systems are difficult to start up in that "loading" the film in the continuous chain device is a tedious time consuming operation.

Accordingly, there is a need for an improved device for placing a seb of film under tension in a packaging machine at the side seal station.

The present invention provides an apparatus for placing a folded web of film under tension. The apparatus includes at least one pair of rollers, a first side of the folded web of film being fed between the pair of rollers, the pair of rollers being mounted out of parallel to the first side of the folded web of film and pulling the first side of the folded web of film in a first direction. The apparatus further including means for preventing a second side of the folded web of film from moving in the first direction.

Preferably, the means for preventing the second side from moving in the first direction urges the second side of the web of film in a second direction opposite the first direction.

Preferably, the apparatus includes a plurality of pairs of rollers.

Preferably, the apparatus includes means for causing a first roller to move to a first position allowing a portion of the folded web of film to be inserted between the pair of rollers and for causing the first roller to move to a second position clamping the portion of the web of film between the first roller and the second roller.

Preferably, the first roller is coupled to an arm that is coupled to a spring that biases the first roller against the second roller clamping the web of film therebetween.

Preferably, the rollers are mounted approximately 2 to about 5 degrees out of parallel to the first side of the web of film.

Preferably, the means for urging a second side of the web of film in a second direction opposite the first direction is a spring biased tensioning arm.

A method of placing a web of film under tension is also provided. The method comprises the steps of: passing the web of film over a former to fold the web of film; passing the web of film around a fill tube structure; creating a fin seal on a first side of the web of film; passing the first side of the folded web of film through at least one pair of rollers mounted out of parallel to the first side of the folded web of film; causing the first side of the folded web of film to be pulled in a first direction by the rollers; and preventing a second side of the folded web of film from moving in the first direction. Preferably, the method includes the step of causing a second side of the web of film to be biased in a second opposite direction.

Accordingly, an advantage of the present invention is to provide an apparatus for placing a web of film under tension in a packaging machine.

Another advantage of the present invention is to provide a film tracking clamp for a packaging machine.

A still further advantage of the present invention is to provide an apparatus for placing a web of film under tension at the side seal station in a form, fill, seal packaging machine.

Still, a further advantage of the present invention is that it provides an apparatus for placing a web of film under tension in a form, fill, seal packaging machine so that side seals can be created in the web of film.

Moreover, an advantage of the present invention is that it provides a film tracking clamp that does not damage the web of film.

Furthermore, an advantage of the present invention is that the apparatus is simple and easy to operate.

Additionally, an advantage of the present invention is that it does not hampr operation speeds of the packaging machine.

A further advantage of the present invention is that it provides a tensioning arm that cooperates with a film tracking clamp to place a web of film in a taut condition.

Another advantage of the present invention is that the apparatus is easy to load with the web of film.

Additional features and advantages of the present invention are described in, and will be apparent from, the detailed description of the presently preferred embodiments, and from the drawings.

The present invention provides an apparatus for tensioning a web of film in a form, fill, seal packaging machine. As used herein the term "form, fill, seal packaging machine" refers to a machine for creating from a flexible web of film, a flexible bag for housing a product. Of course, the apparatus for tensioning the web of film of the present invention can be utilized in other packaging machines or in other apparatus where it is necessary to place a web of film in tension as it is fed through an apparatus or system.

In a typical form, fill, seal packaging machine, a web of heat sealable film is passed over a former that forms the film into a tubular shape. The film is folded longitudinally by the former and heat sealed along abutting longitudinal edges at a fin seal station (to create the fin seal). After the fin seal is created, a first side seal is created in the film. Product is then introduced into the tubular-shaped web of film and a second side seal is then created. The film is then severed to create a flexible package.

Figure 1:
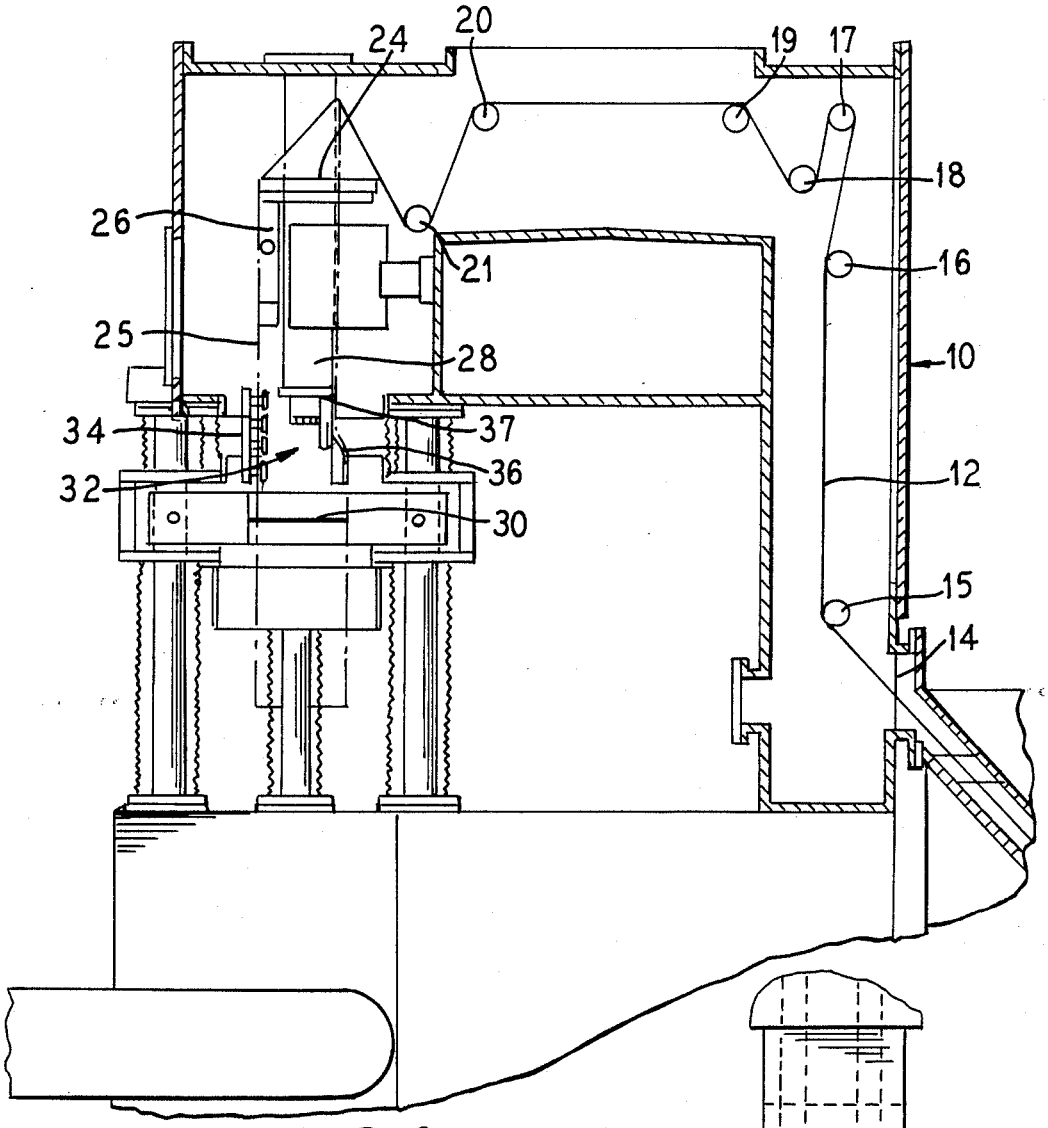
FIG. 1 illustrates a cross-sectional perspective view of a form, fill, seal packaging machine utilizing the present invention.

Referring now to FIG. 1, a form, fill, seal packaging machine 10 is illustrated. As illustrated, the web of film 12 is fed into the packaging machine 10 through an opening 14. Once in the packaging machine 10, the web of film 12 is fed around a plurality of rollers 15, 16, 17, 18, 19, 20, and 21. Of course, although seven rollers 15, 16, 17, 18, 19, 20, and 21 are illustrated, if desired, more or fewer rollers can be utilized. The web of film 12 is then fed to a former 24 that folds the web of film longitudinally so that longitudinal abutting edges of the film can be sealed together to create the fin seal 25 at the fin seal station 26. The folded web of film 12 is then passed around a fill tube structure 28 and side seals are created at the side seal station 30. If desired, fitments can be attached to the web of film 12 at a fitment attaching station. As used herein the term "fill tube structure" means not only the fill tube but also other structures coupled thereto such as, for example, fitment attaching apparatus.

As illustrated, between the fill tube structure 28 and side seal station 30, the apparatus for placing the web of film 12 under tension of the present invention is situated. As discussed in more detal below, the apparatus 32 for placing the web of film 12 under tension includes a tracking clamp 34 and tensioning bar 36. The tracking clamp 34 and tensioning bar 36 cooperate to place the web of film 12 in a taut condition after its passes around the fill tube structure 28 so that side seals can be created in the web of film across a surface that substantially does not include wrinkles and/or creases.

Figure 2:
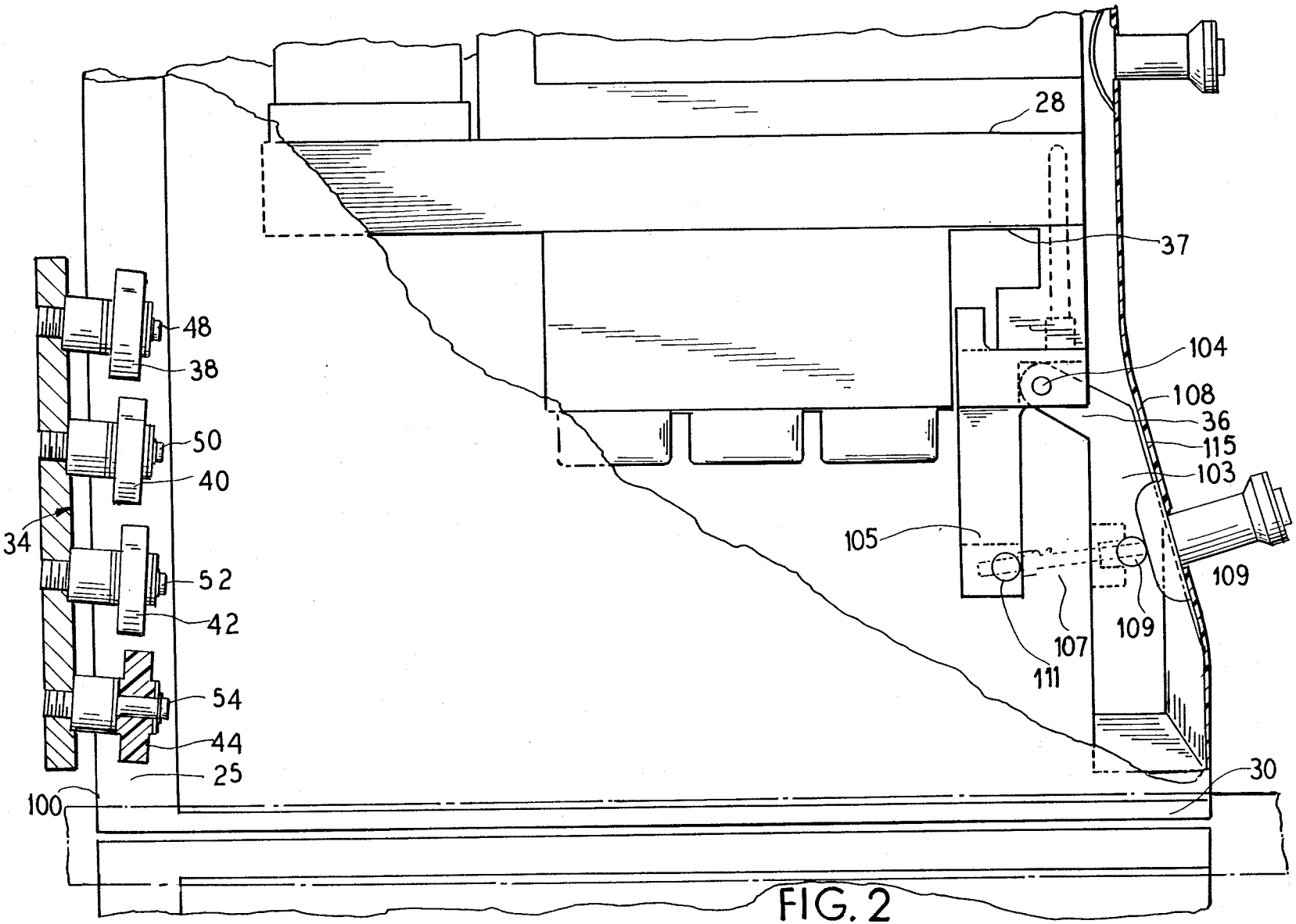
FIG. 2 illustrates a cross-sectional side elevational view of the tracking clamp and tensioning bar of the present invention.
Figure 6:
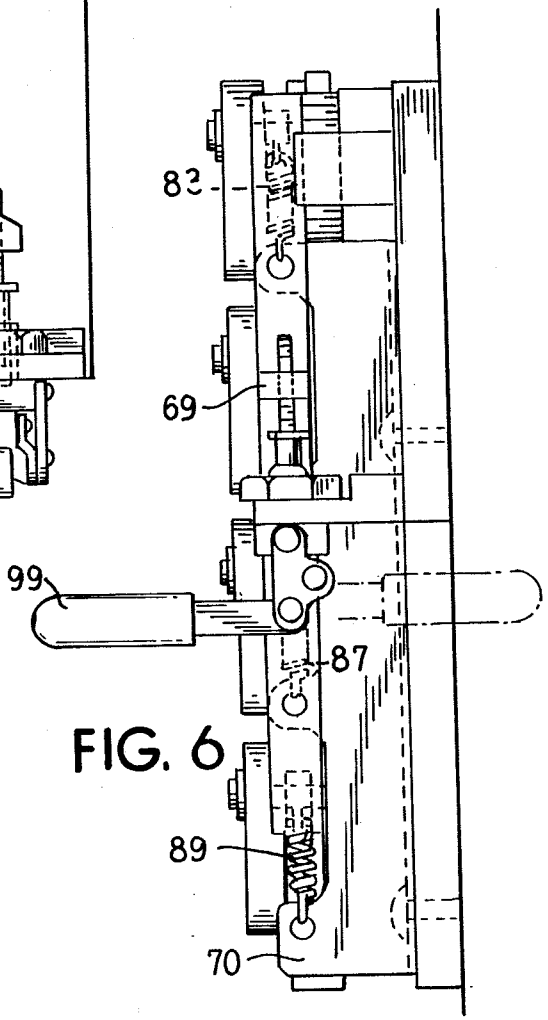
FIG. 6 illustrates a side elevational view of the pivoting means for opening the roller clamps of the tracking clamp of the present invention.
Figure 5:
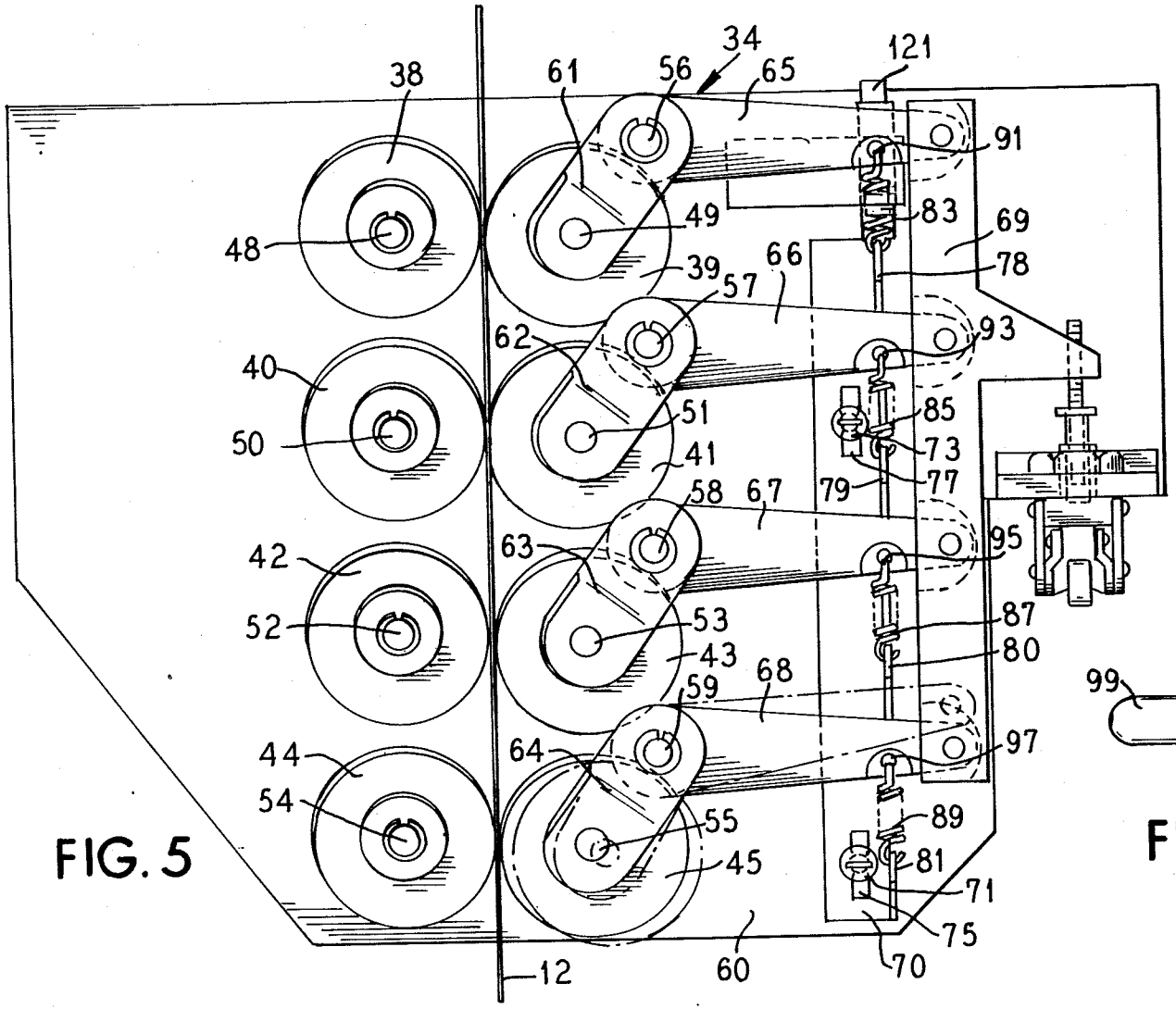
FIG. 5 illustrates a cross-sectional view of the tracking clamp of the present invention.

Referring now to FIGS. 2, 5, and 6, the film tracking clamp 34 of the present invention is illustrated. As illustrated, the film tracking clamp 34 is located in juxtaposition to an end 37 of the fill tube structure 28. The film tracking clamp 34 includes a plurality of rollers 38, 39, 40, 41, 42, 43, 44, and 45 that receive a portion of the folded web of film 12. Specifically, the portion of the web of film 12 that is received between the rollers 38, 39, 40, 41, 42, 43, 44, and 45 is the portion of the web of film 12 that has been sealed to create the fin seal 25 at the fin seal station 26.

The rollers 38, 39, 40, 41, 42, 43, 44, and 45 are constructed so that they freely rotate about shafts 48, 49, 50, 51, 52, 53, 54, and 55, respectively. Shafts 48, 50, 52, and 54 are fixed and thereby remain stationary, while shafts 49, 51, 53, and 55 are movable to allow the rollers 39, 41, 43, and 45 to pivot about pivot members 56, 57, 58, and 59. As discussed in more detail below, this pivoting of the rollers 39, 41, 43, and 45 allows the tracking clamp 34 to be "opened" to allow the web of film 12 to be inserted between the rollers 38, 39, 40, 41, 42, 43, 44, and 45 and then allows the rollers to then be "closed" to trap the web of film between the rollers 38, 39, 40, 41, 42, 43, 44, and 45.

The tracking clamp 34 includes a mounting plate 60 to which the shafts 48, 50, 52, and 54 of the rollers 38, 40, 42, and 44 are secured. The shafts 49, 51, 53, and 55 of the rollers 39, 41, 43, and 45 are secured to plate members 61, 62, 63, and 64 that are secured to arms 65, 66, 67, and 68, respectively, at pivot points 56, 57, 58, and 59. The pivot points 56, 57, 58, and 59 are secured to the mounting plate 60. The arms 65, 66, 67, and 68 are secured to an adjustment plate 69. As discussed hereinafter, the adjustment plate 69 is vertically moveable causing the plate members 61, 62, 63, and 64 and thereby the rollers 39, 41, 43, and 45, to pivot about the pivot points 56, 57, 58, and 59 opening or closing the tracking clamp 34.

The tracking clamp 34 further includes a spring plate 70. The spring plate 70 is adjustably secured to the mounting plate 60 by screws 71 and 73 that are received within slots 75 and 77 in the spring plate 70 and corresponding apertures in the mounting plate 60. Each of the arms 65, 66, 67, and 68 is coupled to a flange 78, 79, 80, and 81 on the spring plate 70 by a spring 83, 95, 87, and 89. To this end, each arm 65, 66, 67, and 68 includes an aperture 91, 93, 95, and 97, respectively, for receiving a portion of the spring 83, 85, 87, and 89. When the tracking clamp 34 is in a closed position, the springs 83, 95, 87, and 89 urge the lever arms 65, 66, 67, and 68 downwardly causing the rollers 39, 41, 43, and 45 to be urged against rollers 38, 40, 42, and 44 thereby clamping the side 100 of the web of film 12 fed therebetween.

In order to open the tracking clamp 34, i.e., to cause the rollers 39, 41, 43, and 45 not to be urged against rollers 38, 40, 42, and 44, a toggle switch 99 is provided. The toggle switch 99 when moved clockwise causes the adjustment plate 69 to move upwardly causing the arms 65, 66, 67, and 68 to move upwardly forcing the plates 61, 62, 63, and 64, and thereby the rollers 39, 41, 43, and 45 to move downwardly away from the corresponding rollers 38, 40, 42, and 44, placing the tracking clamp 34 into an open position. When the toggle switch 99 is then moved counterclockwise, the adjustment plate 69 is forced downward causing the rollers 39, 41, 43, and 45 to contact the corresponding rollers 38, 40, 42, and 44 trapping a side of the folded web of film 12 position between the rollers therebetween. The force with which the rollers 39, 41, 43, and 45 are urged against rollers 38, 40, 42, and 44 can be controlled by adjusting the position of the spring plate 70 with respect to the mounting plate 60. This can be done by adjusting the position of the screws 71 and 73 with respect to the slots 75 and 77 within which they are received or by a spring tensioning screw 121.

Accordingly, to clamp a side 100 of the folded web of film 12 between the rollers 38, 39, 40, 41, 42, 43, 44, and 45 of the tracking clamp 34, the toggle switch 99 is moved to an open position causing the rollers 39, 41, 43, and 45 to move away from the corresponding rollers 38, 40, 42, and 44. The side 100 of the web of film 12 can then be fed therebetween and the toggle switch 99 moved to a closed position wherein rollers 39, 41, 43, and 45 are urged against the corresponding rollers 38, 40, 42, and 44. The tracking clamp 34 thereby functions to trap a first side 100 of the folded web of film 12 between the rollers 38, 39, 40, 41, 42, 43, 44, and 45. It should be noted that in a form, fill, seal packaging machine, the side 100 of the folded web of film 12 received within the roller clamp 34 will include the abutting longitudinal edges of the web of film that are sealed to create the fin seal 25 in the film.

Because the rollers 38, 39, 40, 41, 42, 43, 44, and 45 freely rotate about their respective shafts 49, 51, 53, and 55, as the web of film 12 is pulled through the packaging machine 10, the film freely flows through the tracking clamp 34. Accordingly, the tracking clamp 34 does not unduly slow down the flow of the web of film 12 through the packaging machine 10.

As illustrated in FIG. 2, the tracking clamp 34, and specifically, the rollers 38, 39, 40, 41, 42, 43, 44, and 45 are not oriented so that they are exactly parallel to the side 100 of the folded web of film 12. Instead, the tracking clamp 34 and specifically, the rollers 38, 39, 40, 41, 42, 43, 44, and 45 are located at least one degree out of parallel to the side 100 of the folded web of film 12. Preferably, the rollers 38, 39, 40, 41, 42, 43, 44, and 45 are located approximately 2 to about 5 degrees out of parallel with the side 100 of the web of film 12. This causes the rollers 38, 39, 40, 41, 42, 43, 44, and 45, as the folded web of film 12 is pulled through the packaging machine 10, to exert a force laterally outward on the web of film 12 causing the folded web of film 12 to be urged outwardly as indicated by the arrows in FIG. 2. This outward tension on the folded web of film 12, as described in more detail below, cooperates with the tensioning bar 36 to place the folded web of film 12 under tension, making it taut at the side seal station 30.

It should be noted that although the tracking clamp 34 is illustrated as having four pairs of rollers 38, 39, 40, 41, 42, 43, 44, and 45, additional or fewer rollers can be utilized depending upon requirements. Preferably, the rollers 38, 39, 40, 41, 42, 43, 44, and 45 are covered with a material having a sufficiently high coefficient of friction so that the rollers grip the folded web of film 12 but do not damage the film as it is pulled therethrough. Preferably, the rollers 38, 39, 40, 41, 42, 43, 44, and 45 are covered with a high tear strength rubber. This allows the rollers 38, 39, 40, 41, 42, 43, 44, and 45 to have a minimum squeeze, and as a result reduces any drag on the folded web of film 12 as it is pulled through the form, fill, seal packaging machine 10 yet provides a maximum gripping force for the rollers.

Figure 3:
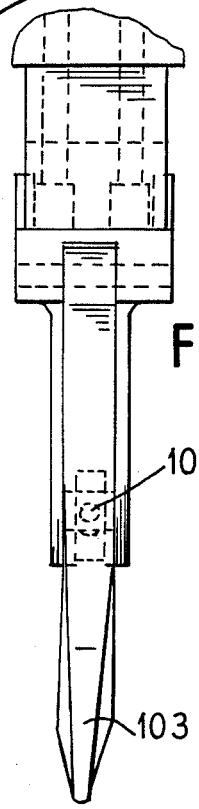
FIG. 3 illustrates a front elevational view of the tensioning bar of the present invention.
Figure 4:
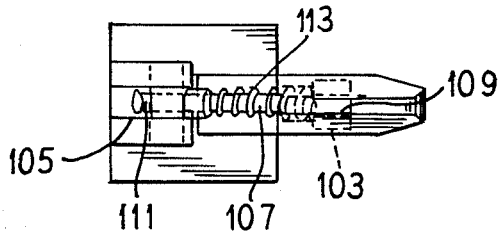
FIG. 4 illustrates a bottom elevational view of the tensioning bar of the present invention.

Referring now to FIGS. 2, 3, and 4, the tensioning bar 36 is illustrated. The tensioning bar 36 extends from a bottom 37 of the fill tube 28. To this end, the tensioning bar 36 includes a tensioning arm 103 that is pivotably connected by a pivot member 104 to a pivot arm 105. A collar shaft spring 107, located between the tensioning arm 103 and pivot arm 105, urges the tensioning arm 103 outwardly away from the pivot arm 105. As illustrated in FIG. 2, this causes the tensioning arm 32 to urge a second side 108 of the folded web of film 12 outwardly.

The collar shaft spring 107 includes at each end thereof pins 109 and 111 that are received within the tensioning arm 103 and pivot arm 105, respectively. A compression spring 113 is located between the tensioning arm 103 and pivot arm 105 and baises the tensioning arm 103 away from the pivot arm 105.

As illustrated in FIG. 2, the tensioning arm 103 preferably is sloped downwardly at a film contact side 115 thereof. This sloped portion of the tensioning arm 103 at the film contact side 115 reduces any drag on the web of film 12 as it is fed past the tensioning arm 36.

The tensioning arm 36 and film tracking clamp 34 cooperate to put the folded web of film 12 under tension and in a taut condition before it is sealed at the side seal station 30. As discussed above, this is accomplished by the rollers 38, 39, 40, 41, 42, 43, 44, and 45 pulling a side 100 of the folded web of film 12 outwardly in a first direction while the tensioning bar 32 urges an opposite side 108 of the folded web of film 12 in an opposite second direction. Accordingly, the web of film 12 is placed in tension between the tracking clamp 34 and the tension bar 36 and is therefore in a taut condition at the side sealing station 30.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A method of creating a flexible package from a web of film in a form, fill, seal packaging machine comprising the steps of:

passing a web of film over a former for folding the web of film;

passing the folded web of film around a fill tube structure;

creating a fin seal on a first side of the folded web of film;

passing the first side of the web of film through a plurality of pairs of rollers;

causing the plurality of pairs of rollers to pull the first side of the film in a first direction;

biasing, with biasing means, a second side of the folded web of film in a second direction;

causing the rollers and biasing means to continue to urge the folded web of film in the first and second direction even after the film has moved to a position below a lowermost portion of the fill tube structure; and terminating a length of the rollers and biasing means at a position in juxtaposition to a sealing means, that is located below the filling means, causing the film to be in tension from an end of the fill tube until the sealing means.

2. The method of claim 1 including the step of creating side seals, with the sealing means, in the folded web of film while the web of film is in a taut condition.

3. The method of claim 1 including the step of causing the second side of the folded web of film to be urged in a second direction opposite the first direction.

4. The method of claim 1 including the step of passing the first side of the folded web of film through four rollers.

5. The method of claim 1 including the step of creating a fin seal on a first side of the folded web of film before the folded web of film is passed through the pair of rollers.

6. An apparatus for placing a folded web of film in tension at a sealing station including sealing means of a form, fill, seal packaging machine, the machine including means for pulling the film through the sealing station comprising:

a plurality of pairs of rollers, located in juxtaposition to an end of a fill tube structure and extending to a position near the sealing means, a first side of the folded web of film being fed between the rollers, the plurality of rollers each being mounted on a shaft in a manner to allow the rollers to freely rotate allowing the film to be pulled through the sealing station, the rollers being mounted out of parallel by at least one degree to the first side of the folded web of film and pulling the first side of the folded web of film in a first direction as the film is pulled through the sealing station; and a tensioning arm extending from the end of the fill tube structure for urging a second side of the folded web of film in a second direction diametric the first direction, the tensioning arm extending to a position near the sealing means, that is located below the filling means, substantially equal to the position the rollers extend to, the rollers and tensioning arm being so constructed and arranged that the film is in a taut condition at the sealing station.

7. The apparatus of claim 6 wherein the plurality of pairs of rollers are mounted out of parallel by approximately 2 to about 5 degrees with respect to the first side of the folded web of film.

8. The apparatus of claim 6 including four pairs of rollers.

9. The apparatus of claim 6 including means for causing a first roller of each pair of rollers to move into a first position allowing a portion of the first side of the folded web of film to be inserted between the pair of rollers and for causing the first roller to move into a second position wherein the pair of rollers clamp the web of film therebetween.

10. The apparatus of claim 9 wherein the means includes an arm to which each first roller is coupled, the arm being coupled to a spring for urging the first roller when it is in the second position against a corresponding roller, and a toggle switch coupled to the arm for causing the arm to move the first roller to the first or second position.

11. The apparatus of claim 10 including means for adjusting the pressure exerted by the spring on the arm.

12. The apparatus of claim 11 wherein the spring is secured at one end to the arm and at a second end to an adjustable plate having means for adjusting the position of the plate with respect to the arm.

13. The apparatus of claim 6 wherein the tensioning bar is spring biased in the second direction.

14. The apparatus of claim 13 wherein the tensioning arm is spring biased by a collar spring coupled at one end of the tensioning arm and at a second end to a member extending from the fill tube structure.

15. The apparatus of claim 6 wherein the rollers have a rubber coated contact surface.

16. A form, fill, seal packaging machine for creating from a flexible web of film, flexible pouches for housing a material comprising:

a fill tube, the packaging machine including means for passing the film around the fill tube, the fill tube including at an end thereof, means for depositing a product in the web of film;

sealing means for creating transverse seals in the web of film, the sealing means being located below an end of the fill tube;

a plurality of pairs of rollers located in juxtaposition to the end of the fill tube and extending from a position near the end of the fill tube to a position near the sealing means, a first side of the web of film being fed between the rollers, the rollers being mounted out of parallel by at least one degree to the first side of the web of film and pulling the web of film in a first direction;

a tensioning arm extending from the end of the fill tube to a position near the sealing means for urging a second side of the film in a second direction diametric the first direction; and the plurality of pairs of rollers and tensioning arm being so constructed and arranged that the web of film is under a constant pressure from an end of the fill tube to a position just before the sealing means causing the film to be in a taut position at the sealing means.

17. The form, fill, seal packaging machine of claim 16 wherein:

each pair of rollers includes a first roller and a second roller; and the rollers are coupled to means for causing the first roller to move to a first position allowing a portion of the folded web of film to be inserted between the pair of rollers and for causing the first roller to move to a second position clamping the portion of the folded web of film between the first roller and second roller.

18. The form, fill, seal packaging machine of claim 17 wherein the first roller is coupled to a spring biased arm that biases the first roller against the second roller when the first roller is in the second position.

19. The form, fill, seal packaging machine of claim 18 including means for adjusting the pressure at which the first roller is urged against the second roller.

20. The form, fill, seal packaging machine of claim 19 wherein the means for adjusting the pressure includes means for adjusting the pressure at which the spring biases the arm.

21. The form, fill, seal packaging machine of claim 16 including four pairs of rollers.

22. The form, fill, seal packaging machine of claim 16 wherein the rollers are mounted out of parallel by approximately 2 to about 5 degrees.

23. The form, fill, seal packaging machine of claim 16 wherein the tensioning arm is spring biased.

24. The form, fill, seal packaging machine of claim 23 wherein the tensioning arm is spring biased by a collar spring.

25. The form, fill, seal packaging machine of claim 16 wherein the rollers include a rubber cover.

* * * * *